US005882116A

United States Patent [19]

Backus

[11] Patent Number: 5,882,116

[45] Date of Patent: Mar. 16, 1999

[54] TAMPER INDICATION DEVICE

[76] Inventor: Alan Backus, 3100 W. Sahara Ave., Suite 116, Las Vegas, Nev. 89102-6001

[21] Appl. No.: 637,340

[22] Filed: Apr. 25, 1996

[51] Int. Cl.[6] ..... B65D 30/08

[52] U.S. Cl. ..... 383/5; 206/807; 283/98; 283/99; 428/916

[58] Field of Search ..... 283/72, 98, 99; 383/5; 428/916; 206/807

[56] References Cited

U.S. PATENT DOCUMENTS

| | | | |
|---|---|---|---|
| 4,295,566 | 10/1981 | Vincek | 428/916 |
| 4,424,911 | 1/1984 | Resnick | 215/365 |
| 4,456,139 | 6/1984 | Kent | 215/252 |
| 4,746,556 | 5/1988 | Matsuguchi et al. | 428/40 |
| 4,755,405 | 7/1988 | Massucco et al. | 428/35 |
| 4,792,053 | 12/1988 | Towns et al. | 215/250 |
| 4,813,541 | 3/1989 | Velasco et al. | 206/459 |
| 4,816,305 | 3/1989 | Stillwell et al. | 428/35 |
| 4,980,222 | 12/1990 | Rivera et al. | 428/195 |
| 4,986,429 | 1/1991 | Singleton, Jr. | 215/230 |
| 4,998,666 | 3/1991 | Ewan | 383/5 |
| 5,015,318 | 5/1991 | Smits et al. | 156/233 |
| 5,060,848 | 10/1991 | Ewan | 383/5 |
| 5,082,702 | 1/1992 | Alband | 428/36.92 |
| 5,084,143 | 1/1992 | Smith | 204/3 |
| 5,103,979 | 4/1992 | Hustad | 383/5 |
| 5,104,704 | 4/1992 | Labes et al. | 428/35 |
| 5,135,262 | 8/1992 | Smith et al. | 283/94 |
| 5,135,313 | 8/1992 | Bowman | 383/5 |
| 5,153,042 | 10/1992 | Indrelie | 428/40 |
| 5,234,732 | 8/1993 | Versic et al. | 428/35.7 |
| 5,294,470 | 3/1994 | Ewan | 428/40 |
| 5,474,194 | 12/1995 | Heilman et al. | 215/230 |
| 5,524,294 | 6/1996 | Richardson et al. | 428/916 |

*Primary Examiner*—Stephen P. Garbe
*Attorney, Agent, or Firm*—Christie, Parker & Hale, LLP

[57] ABSTRACT

Sheets used to indicate when tampering has occurred are described. Such sheets are composed of envelopes with generally thin cross sections containing compressed resilient cores which expand upon envelope breach. Expansion of the resilient core results in an obvious visual change to all or some of the envelope surfaces. Such envelopes may also contain a translucent liquid which greatly aids in amplifying the visual changes such envelopes may exhibit. Embodiments may take the form of applied labels, adhesive tape, wrapping paper, mail envelopes, bottle caps, document enclosures, blister packs, etc. Applications include not only signaling tampering but decorative and other applications as well. Processes for fabrication of embodiments are also described.

8 Claims, 4 Drawing Sheets

TAMPER INDICATION DEVICE

FIELD OF INVENTION

The present invention relates to devices which indicate when tampering has occurred and to barriers which change appearance in response to a rupture in their surfaces.

BACKGROUND OF INVENTION

Many types of tamper indicating devices have been developed in the prior art. Among the most common are those using adhesive tapes which deteriorate in some manner when the tapes are detached from a surface. As an example, tapes with lacerations have been used where the tapes break apart into sections when an attempt is made to lift the tape from a surface. Also, adhesive tapes with very strong adhesives have been used where the tape shreds during detachment. As another example, adhesive tapes comprised of a substrate backed by adhesive with a fragile intermediate printed layer between the substrate and the adhesive have also been used where the printed layer detaches from the substrate and remains attached to a surface when an attempt is made to lift the substrate away from the surface. A variant on this uses selective portions of the printing which detach from the substrate to further communicate attempted tampering.

These adhesive tape devices are generally: messy, easy to defeat, do not necessarily make it obvious when tampering has occurred, and only indicate the grossest of tampering.

Tapes, packaging and containers using chemicals which change color or appearance in response to tampering attempts have also been tried. Depending on the embodiment, these have exhibited drawbacks including: having toxic chemicals which are incompatible with foods and medicine, releasing unpleasant odors, not reacting instantly, and not making it obvious when tampering has occurred.

Tampering indication devices of the present invention improve over these and heretofore known devices in the general field in ways apparent from reading the appended specification and claims.

BRIEF DESCRIPTION OF THE DRAWINGS

In the drawings forming a portion of the disclosure of the present invention.

DETAILED SPECIFICATION OF PREFERRED EMBODIMENTS

The present invention is directed to devices in the form of contoured or flat sheets of material which react to tampering by changing their appearance.

Figure 1:
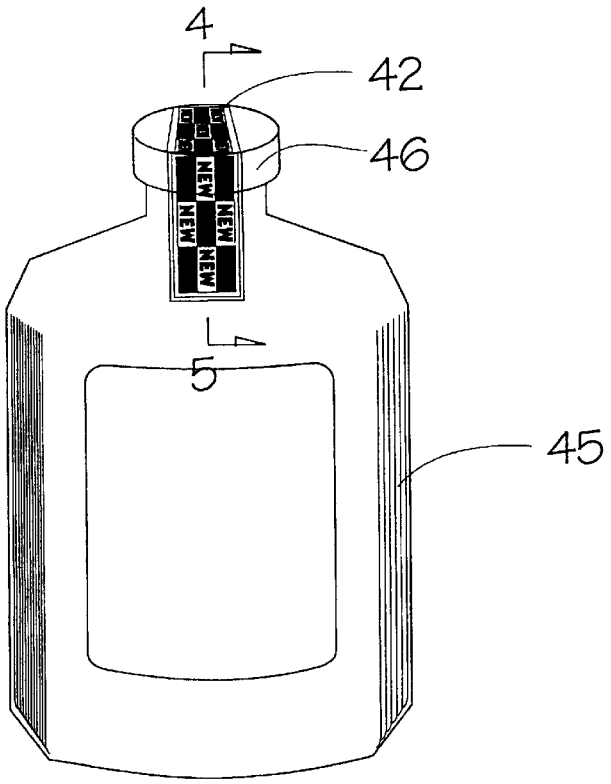
FIG. 1 is a perspective view of a preferred embodiment of the present invention used as a security seal over a twist cap bottle.
Figure 2:
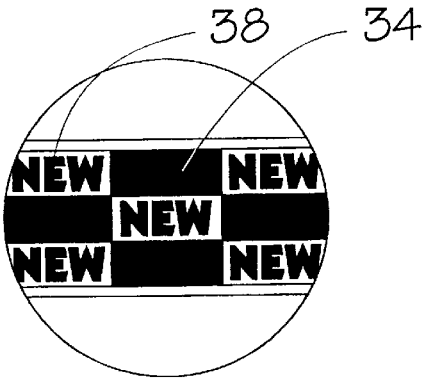
FIG. 2 is a top view of the bottle cap and preferred embodiment security seal shown in FIG. 1 with the seal in its condition prior to removal of the bottle's cap.
Figure 3:
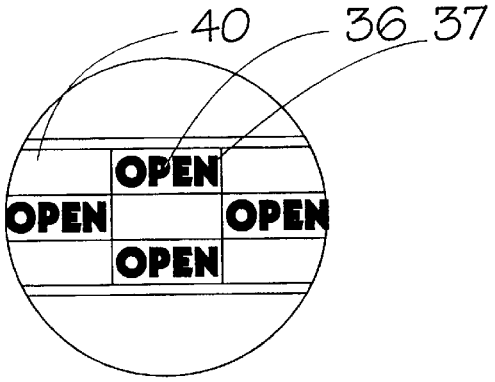
FIG. 3 is the same view as FIG. 2, but with the security seal in its condition after the cap has been removed from the bottle.
Figure 4:
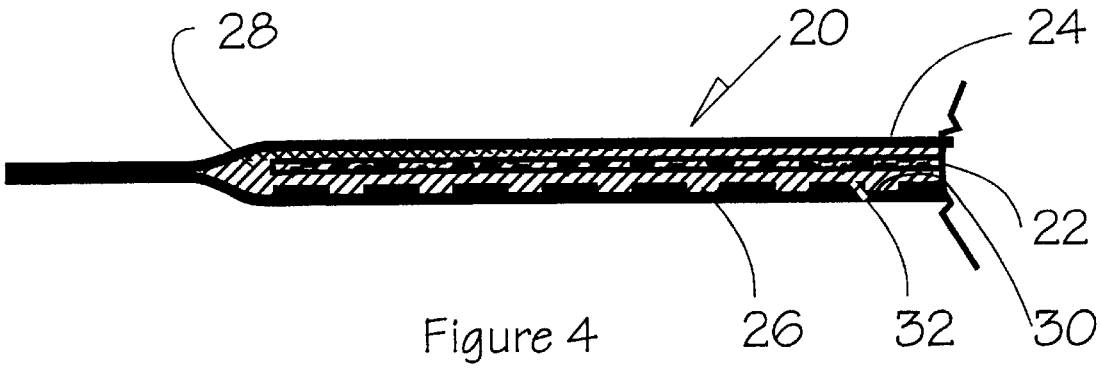
FIG. 4 shows section 4, 5 as defined in FIG. 1 with the embodiment in its condition prior to tampering.

With reference to FIGS. 1 to 5, a preferred embodiment of the present invention is shown which comprises an envelope 20 having a relatively thin cross section and containing a resilient core 22. A portion of the front face 24 of the envelope 20 and a portion of the resilient core 22 when it is compressed as shown in FIGS. 2 and 4 are able to transmit light therethrough.

The envelope 20 is sealed air-tight with the resilient core 22 held in its compressed state as shown in FIG. 4 by outside air pressure against the envelope 20 walls 24, 26. The envelope 20 has at least one area which may respond to tampering by allowing the passage of air into the envelope 20. Before tampering takes place, light passes through the portion of the envelope able to transmit light and through the compressed resilient core 22 allowing visibility at least through the two light transmitting layers 22, 24, those being the front face 24 and the resilient core 22. If the area responsive to tampering is activated and allows air to pass into the envelope 20, the compressed resilient core 22 expands and reduces or eliminates visibility through the resilient core 22.

A feature which may be added to an embodiment incorporating the present invention is the addition of a viscous or non-viscous light transmitting liquid 28 to the inside of the envelope 20. In such a case, when the envelope 20 is sealed and the resilient core 22 is held in its compressed state as shown in FIG. 4, a field of liquid would exist within the envelope 20 between its front 24 and back 26 surfaces as shown in FIG. 4, allowing viewing through the front surface 24 of the envelope 20 of the inside 30 of the back envelope surface 26 which might have printing 32 thereon, or, if the back envelope surface 26 were able to transmit light, possibly to whatever is beyond the back surface 26 of the embodiment envelope 20.

Use of translucent liquid 28 within the envelope 20 greatly enhances the visual changes the embodiment may exhibit. An analogy might be, when liquid 28 is in contact with both the front 24 and rear 26 surfaces of the envelope 20, it is like looking at the sea floor through the bottom of a glass bottomed boat. However, when the envelope 20 is breached and liquid 28 no longer is contacting both the front 24 and rear 26 envelope 20 surfaces, it is like looking at the sea floor from the deck of the boat. In the first case, the sea floor is clearly visible, in the second, the surface of the water is most prominent. In the case of embodiments of the present invention, before the envelope 20 is breached, as shown in FIGS. 2 and 4, the inside 30 of the envelope's back 26, or what is beyond its back 26, is visually predominant; after an envelope 20 is breached, as shown in FIGS. 3 and 5, intermediate layers, including the resilient core 22 and envelope's front surface 24 may become greatly more evident.

This visual effect is enhanced if the index of refraction of the material composing the resilient core 22 is close to the index of refraction for the translucent liquid 28. Common or close to common refraction indexes help in transmission of light through the resilient core 22 before air enters the envelope 20.

There are many potential applications for embodiments of the present invention. For example, embodiments may be adhered, using adhesive, to the top of a bottle 45 as shown in FIGS. 1, 2 and 3.

Figure 5:
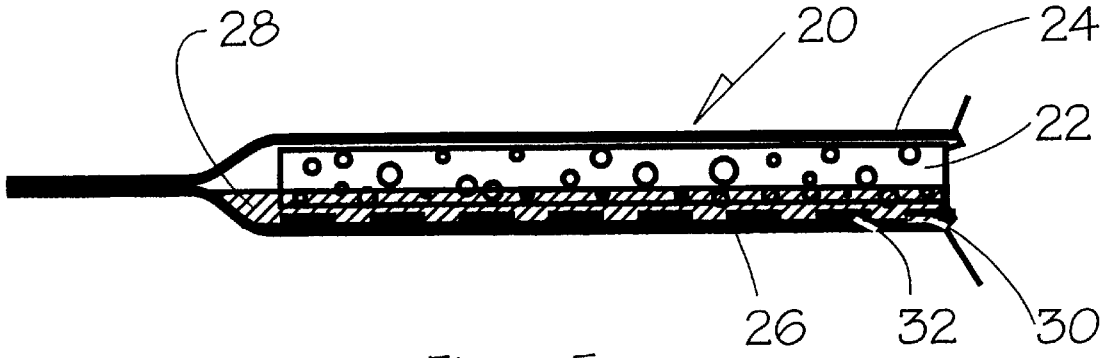
FIG. 5 shows section 4, 5 as defined in FIG. 1 with the embodiment in its condition after tampering.

Once tampering has occurred, the adhesive would cause tearing of the back 26 of the envelope 20, and air would pass into the envelope 20 allowing the resilient core 22 to expand as shown in FIG. 5, thus breaking the field of liquid between the front 24 and back 26 surfaces of the envelope 20, and thus reducing or eliminating transmission of light through the resilient core 22 and thereby exhibiting a highly visible change in the appearance of the envelope 20 as viewed through the envelope's front face 24. By allowing air into the envelope 20 and breaking the liquid 28 field between the envelope's front 24 and back 26 surfaces, the resilient core 22 becomes greatly more visible.

If the resilient core 22 was made of, as an example, a translucent pink open cell polyurethane foam, and the printing 32 on the inside back surface 30 of the envelope 20 was a black square 34, as shown in FIG. 2, and this black square was registered to black printing 36 on the light transmitting front surface 24 of the envelope 20, as an example the word "OPEN" 37 printed in a 25% black lithography screen as shown in FIG. 3, as air entered the envelope 20 and the field of liquid 28 between the envelope's front 24 and back 26 surfaces was broken as shown in FIG. 5, the appearance of the envelope 20 at the location of the black square 34 would change from being a black square 34, as shown in FIG. 2; to the word "OPEN" 37 against a bright pink background, as shown in FIG. 3.

Alternatively, in place of the word "OPEN" 37 in the above example, a user might hand or machine write in black or dark gray their own message which would not be conspicuous until the envelope 20 outer wall was breached.

As a further example, on the same or a different envelope 20, the word "NEW" 38 might be printed on the inside 30 of the back surface 26 of the envelope 20 and be registered to a clear area 40 on the envelope's front surface 24. When air entered the envelope 20, the appearance of the envelope 20 at the location of the word "NEW" 38 would change from the word "NEW" 38 being displayed as shown in FIG. 2 to a bright pink area with no word displayed as shown in FIG. 3.

A further improvement on this would add an agent to the liquid within the envelope 20 which would permanently change with the introduction of air into the envelope 20. As an example, if the liquid used in the envelope 20 were water, a polymer hardener such as is used in acrylic or latex paint to help it dry might be mixed with the water which would irreversibly solidify when air was introduced into the envelope 20. This would greatly help prevent repair of the envelope 20 after tampering.

Other changes known to the art, such as a liquid 28 which permanently changes color or creates crystals or leaves insoluble residues in the presence of air, might also be employed for this purpose.

The envelope 20 may be contoured as flat sheets or contoured surfaces. As examples, it might be a label 42 which goes over a bottle cap 46 as shown in FIGS. 1, 2 and 3 which is broken when the cap 44 is removed by twisting or other means. Alternatively, the envelope may be a seal placed over the mouth of a bottle such as is found on many vitamin bottles. Medicines which might be corrupted by even a hypodermic needle injection might especially benefit from an embodiment using the present invention because even the smallest of such needles would break the envelope's 20 surface 24, 26 and cause a highly visible change to the entire seal.

Figure 12:
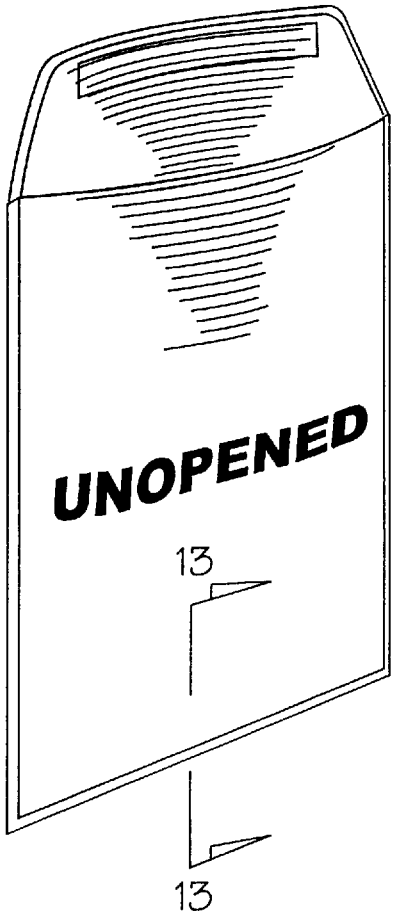
FIG. 12 is a perspective view of a security containment envelope utilizing the present invention.
Figure 13:
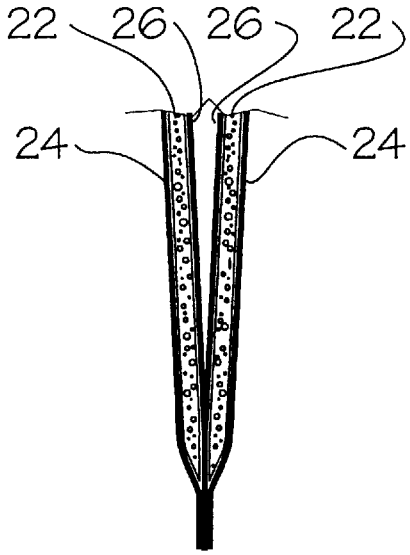
FIG. 13 is a section taken through the containment envelope shown in FIG. 12 as indicated by section arrows 13, 13 in FIG. 12.

Further alternative embodiments of the present invention contemplate embodiment envelopes 20 formed into containment envelopes, like common mail envelopes, as shown in FIGS. 12 and 13, with such embodiment envelopes 20 forming the front and back walls of the containment envelopes as shown in detail in FIG. 13. Such containment envelopes as shown in FIG. 12 might be used to hold documents, mail, computer disks, medicines, or other sundry products or articles. If an attempt were made to penetrate the outer surfaces of such containment envelopes, the entire outside of the containment envelope or a substantial portion thereof could change appearance to indicate attempted tampering. This is particularly important in today's environment where there is no way of detecting whether computer disks or documents have been copied while in transit or storage.

Embodiments might have areas which could be marked on by a user to insure the authenticity of the embodiment. This might comprise an area for a signature or other spaces for user markings. Additionally, it might include holograms or other difficult to reproduce items under such areas or elsewhere to deter copying.

Figure 6:
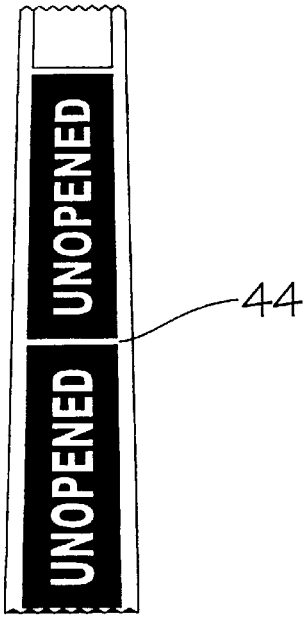
FIG. 6 shows a section of adhesive tape utilizing the present invention.

Embodiment envelopes 20 might be formed into tape with adhesive on the back as shown in FIG. 6 with such embodiment envelopes 20 having seals 44 along the length of the tape every several inches so that when the tape is dispensed and cut, most of its length indicates no tampering until it is ruptured by tampering. Alternatively, the device which dispenses or cuts the tape might seal the tape where it is cut. Either way the tape could be adhesive backed with adhesive strong enough to cause envelope 20 to rupture when the tape was pulled from a surface it was adhered to. Such tape could be used in applications such as sealing mail envelopes, boxes, crime scene doors, safe doors, etc.

Figure 7:
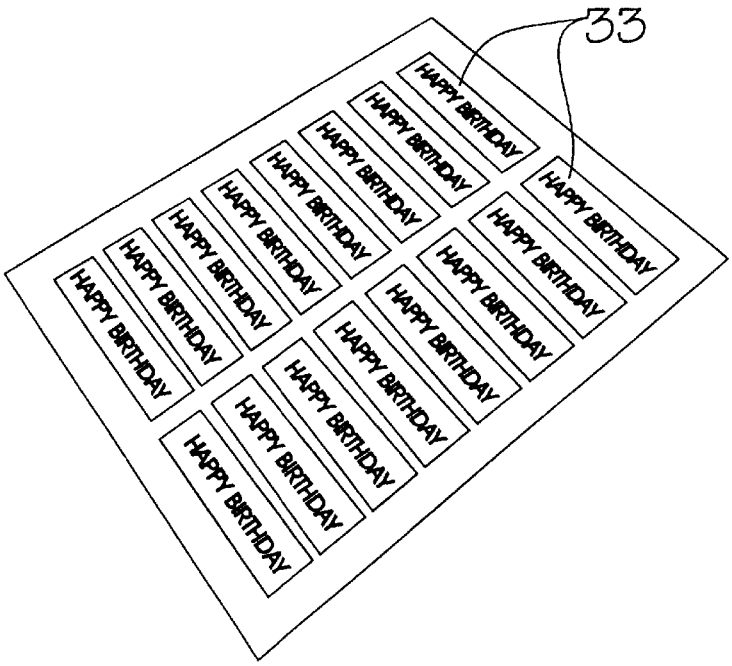
FIG. 7 shows a section of wrapping paper utilizing the present invention.

Preferred embodiment envelopes 20 may be used as wrapping paper, as shown in FIG. 7, again with discrete sections 33 like a quilt or comforter so that it may be cut by an end user without invoking a reaction of tampering. None, all, or just portions of this wrapping paper might contain pressure sensitive adhesive which would cause the back or front of the wrapping paper to rupture if attempts were made to remove the adhered wrapping paper from an object to which it was attached. Such wrapping paper might be used for security or to change messages or appearance when broken or opened. As an example, such wrapping paper might display a message of "HAPPY BIRTHDAY" as shown in FIG. 7 when the paper is torn or cut. Or it might say "OPEN" 37 or "TAMPERED" when it is torn or cut.

Preferred embodiment envelopes 20 might also be formed into boxes or other technical packaging for security or decorative purposes as exemplified above.

Figure 14:
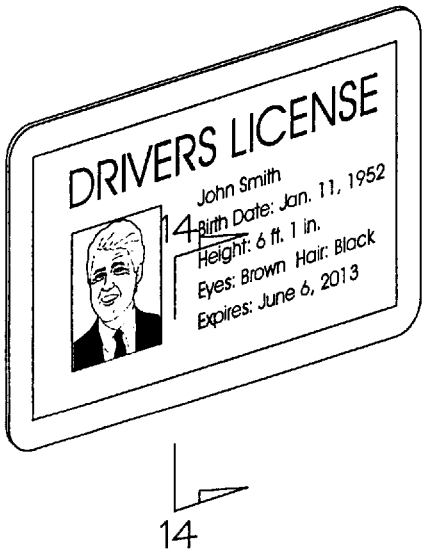
FIG. 14 shows an embodiment of the present invention used to encase a drivers license.
Figure 15:
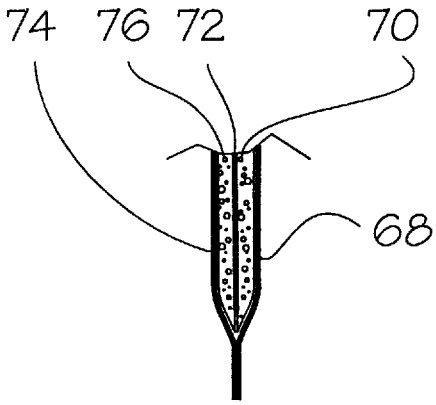
FIG. 15 shows a section indicated in FIG. 14 as section 15, 15 of the embodiment shown in FIG. 14.

Envelopes 20 of the present invention may also be used to hold drivers licenses, credit cards, identification cards, pages of a passport, etc. as shown in FIGS. 14 and 15. In such a case, as an example, the front embodiment envelope 68 surface and the resilient core 70 thereof would be translucent and the document 72 would be either printed on or placed inside the envelope's back surface 74. If the document 72 were tampered with, the entire front surface 68 would become opaque or display a message signalling tampering. A variant of this shown in section detail in FIG. 15 would have the document 72 sandwiched between two translucent resilient cores 70, 76 so both sides of the document 72 would be visible if no tampering had occurred and either side of the embodiment encased document 72 could be viewed to determine if it had become opaque due to attempted tampering. The document 72 could be glued to one or both of the resilient cores 70, 76 as a further means to thwart tampering by making it more difficult to remove the document 72 from the embodiment.

Embodiments might be vacuum formed, drawn, injection molded, etc. into contours such as spheres, geometric forms or sculptural shapes. As an example, blister packs might be made which become opaque if tampering were to occur.

Embodiments may have rigid or semi-rigid walls. As an example, the back wall of an embodiment might be a laminate of air-tight heat sealable plastic onto C flute 200 pound test corrugated cardboard and its front face might be a heat sealable and/or air-tight plastic as described above. Such an embodiment could be formed into shipping boxes which obviously display tampering attempts.

Embodiments may be applied to virtually any surface to show when an attempt to penetrate that surface has occurred. As an example, it could be placed over syringe silicone entry seals on injection medicine bottles or on the sides and bottoms of jewelry display cases.

Fabrication of embodiments might be done in any of many different ways. As an example, to make labels, tape, or sheets, the front surface 24 of an embodiment envelope 20 might be made from a laminate of clear or translucent mylar and polypropylene films and the resilient core might be open cell polyurethane foam and the rear surface 26 of the envelope 20 might be a laminate of aluminum foil and polypropylene. Many air-tight clear plastic laminates are available today which are used in vacuum packing foods in blister packs and shrink film packaging.

There might be printing, possibly in color, on one, two, or all of the following surfaces: the front envelope surface 24, the resilient core 22 and/or the back envelope surface 26. Water could be used for the liquid within the embodiment envelope 20. The use of the materials just described could make it safe to use the embodiment around foods and most medicines.

Embodiment envelopes 20 could be formed by the steps of: 1) heat sealing the envelope's front 24 and rear 26 surfaces around the liquid soaked resilient core 22 leaving an exit opening in the sealed perimeter; 2) pressing the envelope 20 together and thus removing all air and excess liquid through the exit opening by pressing the envelope 20 between two flat plates and; 3) heat sealing the exit opening.

Variations on this might heat seal the envelope's front 24 and rear 26 surfaces together through the resilient core 22 around the envelope's 20 perimeter either by melting the resilient core 22 or by melting material air-tight around the resilient core's 22 material thus forming a seal. This would eliminate having to cut the core to fit inside the envelope 20, and this in turn would save production time, and costs.

The materials which may be used to make the embodiment may be very inexpensive and thus the embodiments using the present invention may adapt well to price sensitive situations. Also, all materials may be non-toxic and compatible with use around foods and medicine. Composition of embodiments may range from paper-like labels to cardboard like sheets to contoured surfaces like blister packs. Heat sealing through the resilient core permits folding scoring and cutting of the embodiment envelopes 20 to form boxes and other packaging. Embodiment envelopes 20 may be three dimensionally formed into blister packs and other products making embodiments very adaptable to many different situations. Potential thinness and compactness make embodiments utilizing the present invention easily adapted to use in existing products such as bottle seals and document enclosures.

A particularly preferred embodiment of the present invention comprises an envelope 20 with a front 24 and back 26 surface enclosing a resilient core 22 and liquid 28. The front surface 24 is an air-tight translucent or transparent heat sealable laminate membrane which is heat sealed to the rear surface 26 which is also a heat sealable laminate membrane whose inside is printed including a brightly colored background. The back surface 26 of the envelope 20 is adhesive backed and is fragile so as to tear if an attempt is made to remove it from a surface to which its adhesive is adhered.

The enclosed resilient core 22 is transparent or translucent and is completely immersed in a transparent or translucent liquid 28 which fills parts of the envelope 20 which are not occupied by the resilient core 22. While the envelope 20 is intact, the enclosed resilient core 22 is compressed by air pressure against the front 24 and back 26 surfaces of the envelope 20 and little or no air is contained within the envelope 20. Thus, while the envelope 20 is intact, it is possible to see through the front surface 24 of the envelope 20, through the liquid 28 and the enclosed resilient core 22 to the inside printed rear surface 30 of the envelope 20. This is helped if the index of refraction of the liquid 28 is close to the index of refraction of the material constructing the resilient core 22. Thus the printed rear inside surface 30 of the envelope 20 is visible through the front surface 24 of the envelope 20.

If an attempt were made to remove the envelope 20 from an object to which it were adhered, the rear surface 26 of the envelope 20 would be ruptured allowing air into the envelope 20. When this occurs, the resilient core 22 expands and the front 24 and rear 26 surfaces of the envelope 20 no longer are connected by the transparent or translucent liquid 28. This reduces visibility through the envelope 20 and makes the resilient core 22 more visible and the printing on the inside rear surface 30 of the envelope 20 less visible or invisible.

Thus, as an example, if the word "NEW" 38 where printed against a bright orange background on the inside 30 of the back surface 28 of the envelope 20, as shown in FIG. 2, while the envelope 20 was adhered to an object and the envelope's 20 outer surfaces 24, 26 were air-tight and intact, the word "NEW" 38 and the bright orange background on which it was printed would be visible through the transparent or translucent front surface 24 of the envelope 20. If an attempt were made to remove the envelope 20 from the object, it would result in the rear surface 28 of the envelope 20 being ruptured and air entering into the envelope 20 and the liquid 28 link between the envelope's front 24 and rear 26 surfaces being broken, which in turn would make the word "NEW" 38 and its bright orange background become less visible or disappear as shown in FIG. 3. In its place, the air enveloped resilient core 22 would appear. So if the resilient core 22 were a translucent pink open cell polyurethane foam, an area of pink would replace the word "NEW" 38 as viewed through the transparent or translucent front surface 24 of the envelope 20 as shown in FIG. 3.

Similarly, if in another area of the inside 30 of the back surface 28 of the same envelope 20, a black square 34 were printed, and registered to it and printed on the front surface 24 of the envelope 20 was the word "OPEN" 37 printed in a black 25% screen, before attempts were made to remove the envelope from an object to which it was adhered, no air would be in the envelope 20 and the black square 34 would be visible through the front surface 24 of the envelope 20 as shown in FIG. 2. If the rear surface 26 of the envelope 20 were ruptured through attempts to remove the envelope 20 from an object to which it was adhered, air would enter the envelope 20 making the black square 34 printed on the inside 30 of the back surface 26 of the envelope 20 disappear and in its place the word "OPEN" 37 would appear against the pink background of the now air enveloped resilient core 22 as shown in FIG. 3.

An air-tight heat sealable clear plastic laminate, similar to those used to vacuum pack various foods such as hot dogs and beef jerky today, might be used to construct the envelope's front surface 24 and a laminate of compatible heat sealable plastic and aluminum foil coated with pressure sensitive adhesive might be used to construct the envelope's rear surface 26. The resilient core 22 might be constructed from open cell polyurethane, or from fiberglass, or from other plastic foams or textured or embossed plastics which might also be frosted, or from natural materials such as paper, cotton, wool or silk or from other materials having similar characteristics.

Assembly could be done by heat sealing the perimeter of the envelope 20 leaving an exit opening and then pressuring or sucking out air and excess liquid from inside the envelope 20 and then heat sealing the exit opening. Many other methods known in the art might also be used to construct the embodiment.

Figure 8:
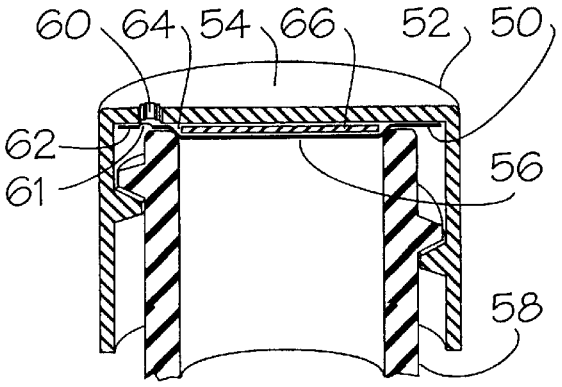
FIG. 8 shows a section, section 8, 8, as specified in FIG. 9, through a bottle cap incorporating the present invention, with the cap in its unopened condition.
Figure 9:
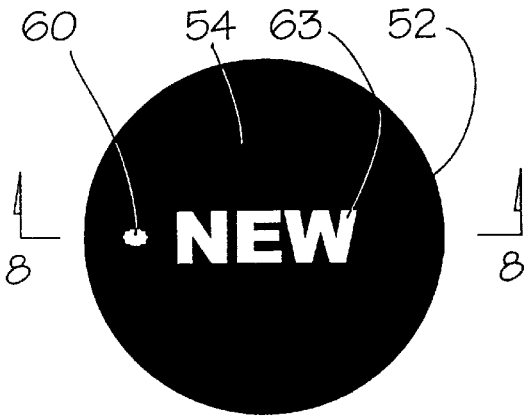
FIG. 9 is a top view of the bottle cap shown in FIG. 8.
Figure 11:
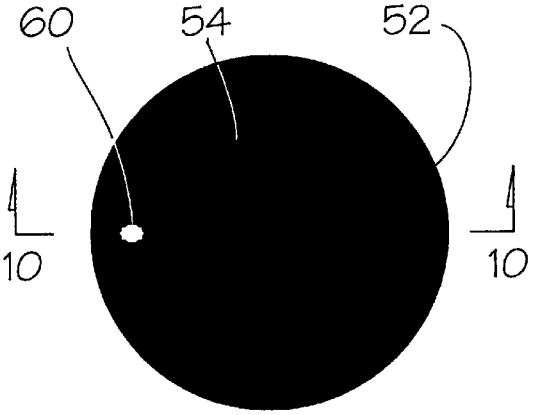
FIG. 11 is a top view of the bottle cap shown in FIG. 10.

Yet another embodiment of the present invention is incorporated as a seal 50 inside a bottle cap 52 as shown in FIGS. 8, 9, 10 and 11. Here, the transparent top 54 of the rigid cap 52 serves as the front face 24 of the envelope 20, and the back 26 of the envelope 20 is a pliable plastic disk 56, made from a polypropylene mylar laminate or other appropriate materials, which may be textured, possibly just on the surface facing into the envelope 20, to help air flow during the tamper activation of this tamper indicating embodiment. The plastic disk 56 doubles as a seal 50 to cover the top of the bottle 58 when the bottle is capped. This plastic disk 56 has printing of the word "NEW" 63 on its top surface as shown in FIG. 9. There are one or more vent holes 60 through the top of the cap 52. These holes 60 may have irregular interiors such as zig zag interior surfaces as shown in FIGS. 8, 9, 10 and 11 that so they are not easily plugged.

The perimeter 62 of the plastic disk 56 is sealed with glue to the inside of the top 54 of the cap 52 forming an envelope 64 with a resilient core 66 of translucent open cell polyurethane foam inside the envelope 64, and with the vent holes 60 also falling inside the glued perimeter 62 of the envelope 64. Before completing the screwing on of the bottle cap 52 onto the bottle 58, the bottle capping equipment putting on the bottle cap 52, through the vent holes 60, fills the envelope 64 formed between the top 54 of the rigid cap 52 and the pliable plastic disk 56 with water, and then the capping equipment removes all air and excess water from the envelope 64 leaving only the now compressed resilient core 66 and a minimal amount water inside the envelope 64.

As explained earlier, this leaves a field of liquid, in this case water, between the printed word "NEW" 63 on the top of the pliable plastic disk 56 and the transparent top 54 of the cap 52, thus clearly displaying the word "NEW" 63 through the transparent cap 52 top 54 as shown in FIGS. 8 and 9.

The water may contain chlorine, hydrogen peroxide, alcohol, or other chemicals to inhibit bacteria growth.

When the cap 52 is finally fully screwed onto the bottle 58 by the bottle capping equipment, the resilient core 66 and the minimal water it is completely immersed in are fully sealed away from the vent holes 60 by the top lip of the mouth of the bottle 58 pressing the pliable plastic disk 56 against the inside of the top 54 of the rigid cap 52. At this time, to further deter tampering, holes 61 may be punched, possibly through the vent holes 60 in portions of the pliable plastic disk 56 which fall outside the seal formed by the mouth of the bottle 58 pressing the disk 56 against the inside of the bottle cap 52.

Figure 10:
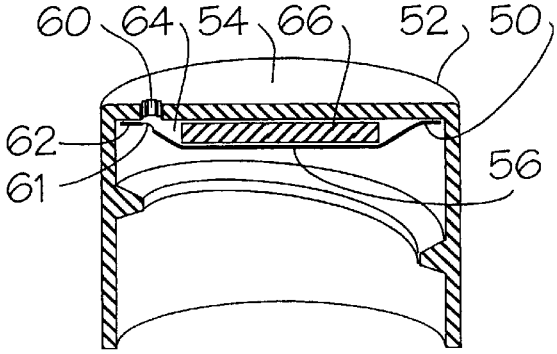
FIG. 10 shows a section, section 10, 10, as specified in FIG. 11, through a bottle cap incorporating the present invention, with the cap in its opened condition.

Later, when the cap 52 is unscrewed from the bottle 58, the seal formed by the bottle neck pressing the plastic disk 56 against the cap 52 is broken and air enters the envelope 64 through the vent holes 60, 61 aided by the compressed resilient core 66 expanding the envelope 64 as shown in FIG. 10. This breaks the field of liquid and allows the resilient core 66 to expand resulting in the word "NEW" being obscured and the resilient core 66 becoming more visible, thus changing the cap's 52 appearance as shown between FIGS. 9 and 11 in response to opening or tampering.

Such an embodiment may be used on bayonet, crimp-on, press-on or other types of bottle caps as well. Applications may be for medicine bottles, liquor bottles, soft drink bottles, cosmetics etc.

All the foregoing is intended as illustrative of the present invention, but not limiting. Numerous variations and modifications may be effected without departing from the scope and spirit of the invention.

As examples, embodiments may be larger or smaller than those described. Materials may be changed, such as using a rigid material such as metal or glass for the front 24 and/or rear 26 envelope surfaces or using viscous liquids 28 or gels, or thin liquids 28 such as petroleum distillates or alcohol. Changing the viscosity or other physical characteristics of the liquid 28 would allow, among other things, adjustment of the time it takes for an embodiment to change its appearance after activation by tampering or other specified triggering means. Any appropriate liquid 28 might be used including: vegetable, mineral, petroleum or other oils, as well as light viscosity liquids such as ammonia, alcohol, acetone, etc.

Envelopes 20 may be made to be resealable and thus reusable by, as an example, using replaceable plugs. Other attachment means might be used to attach an embodiment to an object or surface. Such attachment means could include: riveting, gluing, using screws, using other mechanical fasteners, using mechanical engagement, solvent bonding, sonic welding, metal welding, soldering, or any other appropriate known fastening means. An embodiment might be attached to a surface or object using any portion of the embodiment including its front 24 or back 26 faces or any side or other surfaces the embodiment might have. Air to activate an embodiment could be introduced into an embodiment envelope through a tube or other means thus making it possible for the embodiment to activate or trigger in response to a remote stimulus or event.

Also, an embodiment may not need to be attached to an object or surface to be functional. The liquid 28 might be colored to help in changing the appearance of an embodiment after activation. The resilient core 22 might be made of: plastic foam, fiberglass, plastic fibers such as acrylic fibers, cotton, wool, silk or any other appropriate material. Activation of an embodiment, whether reacting to tampering or other specified input, might be by tearing, breaking, rupturing or otherwise breaching the front face 24, or back surface 26, or edges, or any of the other sections of the envelope 20.

An alternative embodiment of the present invention could have a tamper indicating device which has no portion of the envelope 20 or resilient core 22 able to transmit light, but instead indicates tampering by the visible appearance of puffing out of the envelope 20 when the area responsive to tampering allows air into the envelope 20.

Embodiments may be used for many other applications, such as truck trailer seals, cosmetic packaging, or where a product's newness must be indicated such as small appliances, electronic gear, cameras etc. Other means might be used to construct the envelopes such as gluing, using screws or other mechanical fasteners, crimping etc. Other processes might be used to construct the envelopes such as: constructing an empty envelope 20, sucking the air out of it using a tube or syringe or other means, filling it back up with liquid, then removing all air and excess liquid and sealing the envelope 20. Embodiments may be constructed which are incorporated as an integral part of a product, as an example, as part of an electronics enclosure where, for warranty or other reasons, it is advantageous to show if an attempt has been made to open the enclosure.

Embodiments of the present invention may also be used as coverings for pipes, walls, outsides of containment vessels, etc., where it is important or critical that cracks, flaws or imperfections be detected. As an example, the outer wall of an atomic power reactor vessel could be tiled with embodiment envelopes 20 where the vessel wall serves as the envelope back 26 and there are square tiles of liquid 28 immersed resilient core sheets 22 sealed on their periphery to the wall 26 by clear cover sheets 24 which form the fronts 24 of the embodiment envelopes 20. Air and excess liquid is removed from the envelopes 20 thus holding their resilient cores 22 in a compressed state.

If a fracture or flaw occurs in the reactor wall 26, the envelope 20 becomes breached and the resilient core 22 expands thus changing the envelope's appearance. Such tiles could also be wrapped around pipes such as are found in chemical plants or placed over the exteriors of pressure vessels. Depending on what is likely to leak in such and other applications, the contents 22, 28 of the envelope 20 may be changed accordingly. As an example, if water containing blue dye were likely to leak from a pipe wrapped with embodiment envelopes 20, the resilient core 22 of the envelopes 20 might be a white open cell polyurethane foam without any liquid 28 surrounding it and it might be placed on the pipe 26 which would be painted white. If a leak occurred, the appearance of the envelope 20 would change from being white to turning a bright blue. If an embodiment was used in an application where sulfur dioxide gas were likely to leak from a chemical plant pipe 26, the pipe 26 forming the envelope 20 back 26 might be coated with black paint, and the resilient core 22 might be bright orange with water 28 surrounding it, resulting in the envelope 20 changing from appearing black before a breach occurred, to becoming bright orange after a breach.

Such changes and many others would be obvious after reading the specification to one skilled in the art and thus are implicitly incorporated into this specification which shall be limited in scope solely by the claims as issued.

What is claimed is:

1. A sheet which changes appearance in response to an input, said sheet comprising:

a) an air-tight envelope with a generally thin cross section, b) said envelope including a front surface and a rear surface, c) said front surface being able to transmit light, d) a resilient core enclosed within said envelope, e) said resilient core held in a compressed state by the air-tightness of said envelope until air enters said envelope through a breach in said envelope allowing air to enter said envelope and said resilient core to expand; and f) in combination, said front surface and said resilient core transmitting light noticeably different when said resilient core is compressed than when it is not compressed, whereby the appearance of the sheet is changed when light passing through the combination of said front surface and said resilient core is noticeably different when the resilient core is compressed than when air enters said envelope and said resilient core thereby becomes uncompressed.

2. The sheet of claim 1 wherein said envelope contains a translucent liquid.

3. The sheet of claim 2 wherein said translucent liquid is water.

4. The sheet of claim 2 wherein said translucent liquid irreversibly changes in nature when exposed to air.

5. The sheet of claim 1 wherein there is a marking on the inside of said rear surface of said envelope and said marking is visible through said front surface of said envelope before air enters said envelope and is less visible through said front surface of said envelope after air enters said envelope.

6. A containment envelope which changes its appearance if its outer surface is breached and said containment envelope comprising:

a) a barrier surface contributing to the formation of a containment envelope configured to hold at least one object, b) said barrier surface including an inner skin and an outer skin which are sealed air-tight to one another to form a chamber in which there is a compressed resilient core, c) said compressed resilient core becoming uncompressed if a breach occurs in said outer skin allowing air into said chamber, d) said outer skin and said resilient core together transmitting light differently when said resilient core is compressed than when it is uncompressed, whereby piercing the outer surface of the containment envelope causes the resilient core to decompress and thus causes the outward appearance of the containment envelope to change.

7. The containment envelope of claim 6 wherein said chamber also encloses a translucent liquid.

8. A device which visually indicates tampering by a change of appearance when tampering occurs, comprising:

an air-tight enclosure with a generally thin cross section, said enclosure including a front surface and a rear surface, said front surface being able to transmit light; and a resilient core enclosed between said front and rear surfaces, said resilient core held in a compressed state by the air-tightness of said enclosure until said air-tight enclosure is breached resulting in air entering into said enclosure and said resilient core becoming uncompressed; whereby light transmitted by said front surface and said resilient core is visually different when said resilient core is compressed than when it is not compressed.

* * * * *